US011280336B2

(12) United States Patent
Ehringer et al.

(10) Patent No.: US 11,280,336 B2
(45) Date of Patent: Mar. 22, 2022

(54) ROTARY PUMP WITH A LUBRICANT FEED CONNECTING A ROTOR BEARING AND A RADIAL SEALING GAP

(71) Applicant: Schwäbische Hüttenwerke Automotive GmbH, Aalen-Wasseralfingen (DE)

(72) Inventors: Michael Ehringer, Bad Schussenried (DE); Gerd Jäggle, Ertingen (DE); Sven Peters, Bad Schussenried (DE); Holger Braasch, Pfullendorf (DE); Winfried Baur, Altheim (DE)

(73) Assignee: Schwäbische Hüttenwerke Automotive GMbH, Aalen (DE)

( * ) Notice: Subject to any disclaimer, the term of this patent is extended or adjusted under 35 U.S.C. 154(b) by 256 days.

(21) Appl. No.: 16/369,211

(22) Filed: Mar. 29, 2019

(65) Prior Publication Data

US 2019/0301455 A1 Oct. 3, 2019

(30) Foreign Application Priority Data

Mar. 29, 2018 (DE) ..... 102018107695.9

(51) Int. Cl.
*F04C 15/00* (2006.01)
*F01M 1/02* (2006.01)
*F04C 2/08* (2006.01)

(52) U.S. Cl.
CPC ..... *F04C 15/0088* (2013.01); *F01M 1/02* (2013.01); *F04C 2/084* (2013.01); *F04C 2/086* (2013.01);
(Continued)

(58) Field of Classification Search
CPC ..... F04C 15/0088; F04C 2/30; F04C 2/084; F04C 2/10; F04C 2/086; F04C 2/3446;
(Continued)

(56) References Cited

U.S. PATENT DOCUMENTS 1,177,922 A * 4/1916 Brown ..... B65F 1/163 220/262
3,904,333 A 9/1975 Stoeckelmann
(Continued)

FOREIGN PATENT DOCUMENTS

DE 10239558 A1 3/2004
DE 102007031909 A1 1/2009
(Continued)

OTHER PUBLICATIONS

German Search Report issued in German Patent Application No. 10 2018 107 695.9 dated Jan. 15, 2019, 7 pages.

*Primary Examiner* — Mary Davis
*Assistant Examiner* — Paul W Thiede
(74) *Attorney, Agent, or Firm* — RatnerPrestia

(57) ABSTRACT

A rotary pump, the rotational direction of which can preferably be switched, featuring: a housing including a pump space featuring an inlet into a low-pressure region of the pump space for a fluid to be pumped and an outlet from a high-pressure region of the pump space for the fluid to be pumped; at least one rotor which forms delivery cells in the pump space; a bearing; and a sealing stay which axially faces the at least one rotor and separates the low-pressure region from the high-pressure region in the rotational direction of the at least one rotor; and featuring at least one lubricant feed, in the sealing stay, which feeds a fluid, as a lubricant, from at least one of the delivery cells to the bearing.

15 Claims, 8 Drawing Sheets

(52) U.S. Cl.
CPC . *F04C 15/0026* (2013.01); *F01M 2001/0238* (2013.01); *F04C 2210/206* (2013.01); *F04C 2240/30* (2013.01)

(58) Field of Classification Search
CPC ..... F04C 15/0026; F04C 2210/206; F04C 2240/30; F04C 15/003; F01M 1/02; F01M 2001/0238; B65F 1/163
See application file for complete search history.

(56) References Cited

U.S. PATENT DOCUMENTS

| | | | | |
|---|---|---|---|---|
| 4,927,343 | A | 5/1990 | Lonsberry | |
| 5,641,281 | A * | 6/1997 | Russell | F01C 21/02 418/102 |
| 9,017,205 | B2 | 4/2015 | Steinwender | |
| 10,578,101 | B2 * | 3/2020 | Ehringer | F04C 2/10 |
| 2004/0228752 | A1 * | 11/2004 | Peters | F04C 15/003 418/206.4 |
| 2017/0306950 | A1 | 10/2017 | Ehringer et al. | |

FOREIGN PATENT DOCUMENTS

| | | | |
|---|---|---|---|
| DE | 102010056106 | A1 | 6/2012 |
| DE | 102016107447 | A1 | 11/2017 |
| EP | 0300293 | A2 | 1/1989 |
| EP | 1801418 | A1 | 6/2007 |
| WO | 2008062023 | A1 | 5/2008 |

* cited by examiner right-hand depiction left-hand depiction right-hand depiction left-hand depiction right-hand depiction left-hand depiction right-hand depiction left-hand depiction

ROTARY PUMP WITH A LUBRICANT FEED CONNECTING A ROTOR BEARING AND A RADIAL SEALING GAP

CROSS REFERENCE TO RELATED APPLICATIONS

This application claims priority to German Patent Application No. 10 2018 107 695.9, filed Mar. 29, 2018, the contents of such application being incorporated by reference herein.

FIELD OF THE INVENTION

The invention relates to a rotary pump, the rotational direction or delivery direction of which can preferably be switched, featuring a housing comprising a pump space featuring an inlet into a low-pressure region of the pump space for a fluid or medium to be pumped and an outlet from a high-pressure region of the pump space for the fluid or medium to be pumped. The pump also comprises at least one rotor which forms delivery cells in the pump space, and at least one bearing for the at least one rotor and/or for a rotor shaft which is connected to the rotor. The pump also comprises a sealing stay which axially faces the rotor and separates the low-pressure region from the high-pressure region in the rotational direction of the rotor.

BACKGROUND OF THE INVENTION

It is in particular important, in rotary pumps, for the bearing to be well lubricated at all times, in order to prevent the pump from becoming damaged or even fretted, to maintain free movement of the pump, and to avoid or at least delay wear on the bearing.

SUMMARY OF THE INVENTION

An aspect of the invention is a rotary pump in which a lubricant is reliably fed to the bearing at all times while the pump is in operation.

A first aspect of the invention relates to a rotary pump, preferably one in which the rotational direction can be switched, featuring: a housing which comprises a pump space featuring an inlet into a low-pressure region of the pump space for a fluid or medium to be pumped and an outlet from a high-pressure region of the pump space for the fluid or medium to be pumped; at least one rotor which forms delivery cells in the pump space; at least one bearing for the at least one rotor and/or for a rotor shaft which is connected to the rotor; and a sealing stay which axially faces the rotor and separates the low-pressure region from the high-pressure region in the rotational direction of the rotor. In accordance with an aspect of the invention, the rotary pump comprises at least one lubricant feed, in the sealing stay, which feeds a fluid from at least one of the delivery cells to the bearing. The sealing stay and the rotor preferably form an axial sealing gap. The size of the axial sealing gap between the sealing stay and the rotor is increased in or by the lubricant feed. The rotary pump is preferably embodied as an externally toothed wheel pump in which the rotational direction can be switched.

The housing can comprise one or more parts, for example one or more covers, in order to seal openings. Parts of the housing can form part of the pump chamber, for example an axial cover for the pump chamber or a circumferential wall or cup-shaped structure for accommodating the at least one rotor.

The rotor can be connected or coupled to a drive, such as for example an electric motor and/or a shaft which is driven by an internal combustion engine, which generates the drive energy for the rotor. The rotor is preferably connected to a rotor shaft. Preferably, the rotor shaft is rotatably mounted in the bearing. The rotor shaft is advantageously connected or coupled to the drive.

A rotational direction or delivery direction of the rotary pump or the at least one rotor can preferably be switched, such that the pump can be flexibly employed. When the pump changes from a first rotational direction to a second rotational direction, the outlet of the pump rotating in the first rotational direction becomes the inlet for the same pump now rotating in the second rotational direction. This correspondingly applies to the inlet of the pump, which becomes the outlet after the pump has changed rotational direction. In both rotational directions, the inlet emerges into a low-pressure region of the pump, and the outlet emerges into a high-pressure region of the pump. Switching the rotational direction of the pump thus changes the delivery flow direction of the fluid or medium to be delivered through the pump; in other words, the pump is a reversible rotary pump.

The fluid or medium to be pumped can in particular be a lubricant, such as a lubricating oil, which is fed to one or more assemblies, for example from the high-pressure side of the pump, via flexible tubes or conduits, in order to lubricate the assemblies. Alternatively or additionally, the fluid or medium to be pumped can be a cooling or actuating fluid. It can also however be a fluid or medium with a different purpose, for example a heating oil, heavy oil or diesel. The fluid to be pumped is simultaneously used to lubricate the bearing. The low-pressure side of the pump can be fluidically connected to a reservoir for the fluid or medium to be pumped.

The lubricant feed is preferably suitable for reliably supplying the bearing with the fluid or medium, irrespective of the rotational direction or delivery direction of the pump. Preferably, there is no position of the rotor within the pump space at which the lubricant feed can be short-circuited with the inlet into the pump space or the outlet from the pump space, i.e. a direct fluidic connection between the lubricant feed and the inlet or outlet is to be ruled out. A short-circuit with the inlet or suction side of the pump can for example reduce, prevent or even reverse a flow of the lubricant to the bearing via the lubricant feed, which could lead to an insufficient supply of lubricant to the bearing. This could result in the rotary pump being damaged, up to and including being destroyed. The lubricant feed which is independent of the rotational direction or delivery direction is prevented from being short-circuited with the inlet in both rotational directions. A change in the rotational direction, by which an outlet becomes the inlet, preferably does not change the supply of lubricant to the bearing.

The housing can comprise an inner circumferential wall which radially delineates the pump space and, together with the at least one rotor, forms a radial sealing gap in order to seal off adjacent delivery cells. This sealing gap or, respectively, a radial width of said sealing gap, can vary in size in the rotational direction, i.e. a distance between an imaginary radial outer circular circumference of the rotor—which for example includes the radial ends of delivery elements which delineate adjacent delivery cells from each other in the rotational direction of the pump—and the radial inner circumferential wall of the pump space can differ in size.

Radial dimensions of the sealing gap, in particular in a circumferential region in which the lubricant feed is formed, can thus be smaller than an average radial distance between the circular circumference and the inner circumferential wall. In other words, the radial sealing gap can be smaller, in the circumferential region of the lubricant feed, than an average radial sealing gap.

The terms "axial" and "radial" refer in particular to the rotary axis of the rotor or rotor shaft, such that the expression "axial" denotes in particular a direction extending parallel to or coaxial with the rotary axis. Furthermore, the expression "radial" denotes in particular a direction extending perpendicular to the rotary axis.

The radial sealing gap or, respectively, the circumferential regions featuring the larger and smaller sealing gap in the rotational direction of the rotary pump, can exhibit uniform or variable dimensions in the axial direction. The radial sealing gap can likewise vary in size in the axial direction. In order to increase the size of the radial sealing gap in a circumferential region, the size of the radial sealing gap can be increased over an axial partial length of the circumferential region only. In order to decrease the size of the radial sealing gap in a circumferential region, the size of the radial sealing gap can be decreased over an axial partial length of the circumferential region only. Preferably, the size of the radial sealing gap is increased or decreased over its entire axial length. The radial sealing gap in the circumferential region in which the radial sealing gap is larger than the radial sealing gap in at least one other circumferential region can be larger than the radial sealing gap in the at least one other circumferential region over an axial partial length or over its entire axial length. The radial sealing gap in the circumferential region in which the radial sealing gap is smaller than the radial sealing gap in at least one other circumferential region can be smaller than the radial sealing gap in the at least one other circumferential region over an axial partial length or over its entire axial length.

If a lubricant feed is for example formed in an axial end-facing wall of the pump space only, the larger sealing gap can in particular also be embodied, on the side of the lubricant feed, over an axial partial length only. If a lubricant feed is for example provided in each of the two axial end-facing walls of the pump space, the larger sealing gap can be embodied, on both sides, over an axial partial length only, wherein the two axial partial lengths are separated by a stay which for example has the dimensions of the smaller sealing gap. The stay can in turn comprise interruptions, in order to fluidically connect the two axial partial lengths to each other.

The radial sealing gap in the circumferential region of the pump space between the low-pressure region or inlet into the pump space and the lubricant feed, and/or between the high-pressure region or outlet from the pump space and the lubricant feed, can preferably be larger than the sealing gap in the circumferential region of the lubricant feed. A certain leakage, preferably a defined leakage, between the delivery cells is to be set by the larger radial sealing gap. Due to the smaller radial sealing gap in the circumferential region of the lubricant feed, the delivery cells currently passing over the lubricant feed are therefore more effectively sealed off than the other delivery cells. This ensures that the bearing is supplied with enough lubricant or, respectively, that the lubricant pressure is high enough to for example reliably deliver the lubricant into the bearing.

Instead of changing the size of the sealing gap as a whole, grooves can be formed, in the circumferential region in which there is no lubricant feed arranged in the pump space, in the inner circumferential wall and/or in inner sides of the axial end-facing walls of the pump space which face the rotor, for example in the base and/or cover, wherein the grooves connect adjacent delivery cells to each other in the circumferential regions of the pump chamber with no lubricant feed and thus ensure a certain leakage.

In, the circumferential region of the lubricant feed, the circumferential region featuring the smaller sealing gap extends in the rotational direction of the rotor over a circumferential portion of the inner circumferential wall which is larger than one delivery cell. The circumferential region featuring the smaller sealing gap extends for example over two or more delivery cells. In the case of the sealing gap, this preferably means that the extent of the circumferential region featuring the smaller sealing gap in the rotational direction of the rotor is larger than an extent in the rotational direction of said one delivery cell on the imaginary circular circumference of the rotor.

The radial sealing gap, in a toothed wheel pump in particular, can be referred to as a tip clearance. The radial sealing gap is preferably formed between a tooth tip of a rotor, which is embodied as a toothed wheel, and the inner circumferential wall. The radial sealing gap or tip clearance in the circumferential region of the inner circumferential wall, which lies radially opposite the lubricant feed, advantageously measures 100 μm at most. The radial sealing gap or tip clearance in the circumferential region of the inner circumferential wall, which lies radially opposite the lubricant feed, is particularly advantageously smaller than 100 μm and most particularly advantageously smaller than 75 μm. The radial sealing gap or the tip clearance in the circumferential region of the inner circumferential wall between the lubricant feed and the low-pressure region or high-pressure region is advantageously at least 1.5 times and particularly advantageously at least two times larger than the radial sealing gap or the tip clearance in the circumferential region of the inner circumferential wall, which lies radially opposite the lubricant feed. The radial sealing gap or the tip clearance in the circumferential region of the inner circumferential wall between the lubricant feed and the low-pressure region or high-pressure region is advantageously at most 2.5 times and particularly advantageously at most three times larger than the radial sealing gap or the tip clearance in the circumferential region of the inner circumferential wall, which lies radially opposite the lubricant feed. The larger radial sealing gap is advantageously at least 1.5 times and particularly advantageously at least two times larger than the smaller radial sealing gap. The larger radial sealing gap is advantageously at most 2.5 times and particularly advantageously at most three times larger than the smaller radial sealing gap.

The lubricant feed can in particular be a recess or groove which extends, preferably starting at the bearing, far enough in the radial direction that the delivery cells pass over it successively when the rotor is rotating. The recess can be a straight line which for example lies on a beam which intersects or extends parallel to a rotary axis of the rotor or rotor shaft. The recess can also extend in a curve or undulation or can assume any other shape. The recess can comprise bifurcations or elongations which extend in or counter to the rotational direction of the rotor. The recess can thus for example be formed in the shape of an L, a T, a Y, an F or a V, without being limited to these embodiments. The recess can be of any shape, for example U-shaped, V-shaped or rectangular; the depth of the recess can vary. An end of the recess which faces away from the bearing, and/or the sides of the recess, can for example, at least in regions, emerge via an oblique surface into the inner side of the axial wall of the pump space which faces the rotor, such that the lubricant can flow into the recess.

The recess can emerge into the bearing at one end, and the point at which it emerges can be the only connection between the recess and the bearing. Alternatively or additionally, the recess can be connected to the bearing via one or more channels, such that the lubricant can be fed to the bearing at multiple points simultaneously.

The lubricant feed can be arranged centrically in the sealing stay, i.e. it can have a substantially equal distance from a nearest edge of the mutually facing ends of the outlet and inlet. Due to this centric or central arrangement, the geometry of the pump in relation to the lubricant feed is identical in both rotational directions if the recess is correspondingly shaped. The inlet and the outlet into the pump space can preferably also have substantially the same shape.

The lubricant feed can preferably be arranged eccentrically in the sealing stay, nearer the inlet for the medium to be pumped in the first rotational direction. This can be expedient when the rotary pump has a preferred first rotational direction and a less preferred second rotational direction or delivery direction. In this case, the eccentric arrangement of the lubricant feed is advantageous, since a distance between the lubricant feed and the inlet is larger, in a main operation in the first rotational direction or delivery direction, than if centrically arranged, thus more reliably preventing the lubricant feed from being able to be short-circuited with the inlet.

The rotary pump can in particular be an external-axle pump, such as for example an externally toothed wheel pump. The pump can be embodied in a planetary gear design, i.e. the pump comprises for example a driven toothed wheel which outputs onto multiple other toothed wheels or vice versa. Such pumps featuring a planetary wheel set are known for example from DE 10 2010 056 106 B1, EP 1 801 418 A1, EP 0 300 293 A2 and WO 2008/062023 A1, which are incorporated by reference herein, wherein aspects of the invention are not restricted to the example embodiments shown and described in those documents but rather also includes pumps which deviate from this, in particular external-axle pumps such as for example externally toothed wheel pumps.

The lubricant feed can be or comprise a groove in the sealing stay. The groove can be embodied to be rectangular, U-shaped or V-shaped or any other shape in a section transverse to its longitudinal axis. A width and a length of the groove can be adapted to the rotary pump. The groove can be funnel-shaped at its end which faces the bearing and/or at its end which faces away from the bearing. The longitudinal sides of the groove can extend parallel to each other or can be inclined towards or away from each other in the direction of the bearing, such that a width of the groove varies continuously over its length. The same can apply to the depth of the groove. The shape of the groove, such as its length, width and depth, is in principle not fixed but can rather be freely selected by the person skilled in the art. A groove can also be divided like a delta, such that the groove comprises multiple arms on at least one of its ends. Lastly, the groove need not form a straight line, but can rather for example be slightly curved.

The lubricant feed can comprise a pocket in the sealing stay. The pocket can terminate directly at the bearing or can be connected to the bearing via a groove or bore. The pocket can be round, oval, rectangular or shaped in any other way in its length, width and depth.

A short-circuit with the inlet or suction side of the pump can reduce, prevent or even reverse a flow of the lubricant to the bearing via the lubricant feed, which could lead to an insufficient supply of lubricant to the bearing. This could result in the rotary pump being damaged, up to and including being destroyed.

An imaginary elongation of the groove or bore or, respectively, an axial center axis of the groove or bore can intersect a rotary axis of the rotor or a straight line which extends parallel to the rotary axis of the pump, i.e. the imaginary elongation of the groove can meet a circumferential outer surface of the bearing in at least one point, perpendicularly or at an angle which can be predetermined at the design stage.

In the sealing stay which is formed between the inlet and the outlet in the rotational direction of the rotor, the lubricant feed can extend from the bearing to between the inlet and the outlet, wherein if the lubricant feed is groove-shaped, the end of the lubricant feed which faces the bearing can be open, and the end of the groove-shaped lubricant feed which faces away from the bearing can be closed with no pocket.

The pump space is generally delineated at its axial ends by a cover and a base. The inlet, outlet, sealing stay and lubricant feed can selectively be formed in the cover or base of the pump space or in both the cover and base of the pump space. The rotary pump can comprise two inlets into the low-pressure region of the pump space, two outlets from the high-pressure region of the pump space, two sealing stays which axially face the rotor and separate the low-pressure region from the high-pressure region in the rotational direction of the rotor, and a lubricant feed in each of the two sealing stays.

The rotary pump can have two rotors in the form of toothed wheels which mesh with each other in a known way in a driving stay. Each of the two rotors or each of the two rotor shafts has a bearing, and each of the bearings is assigned a lubricant feed as previously described. The two lubricant feeds can be connected to each other via the driving stay. The same applies to a rotary pump featuring three rotors, two of which respectively mesh with each other in a driving stay. Each of the rotors can be assigned a lubricant feed as previously described; two of the lubricant feeds or all three lubricant feeds can be connected to each other via a driving stay or the driving stays. If the rotary pump comprises more than three toothed wheels, the above statements apply accordingly.

A meshing engagement between the rotors which are embodied as toothed wheels is preferably lacking in the sealing stay as previously described. The delivery cells which supply the lubricant feed with the fluid or medium are advantageously delineated or formed by the axially opposing sealing stays, the inner circumferential wall and the rotor.

The rotor can be connected or coupled to a drive, such as for example an electric motor or a shaft driven by an internal combustion engine, wherein said drive generates the drive energy for the rotor. The rotor is preferably connected to an electric motor and in particular designed to be used in a motor vehicle. If the motor vehicle comprises an internal combustion engine as its drive, then the rotary pump can be driven by the electric motor, preferably independently of the internal combustion engine, for example when the internal combustion engine is at a stop. The rotary pump can advantageously comprise the electric motor. The rotary pump is preferably embodied as an electric rotary pump. The rotary pump can be embodied as an auxiliary pump and/or additional pump for supporting and/or at least partially replacing a main or primary pump in a lubricant and/or coolant system of the motor vehicle. The rotary pump can be provided in order to lubricate and/or cool a drive motor and/or gear system of the motor vehicle. The motor vehicle can be a motor vehicle driven be an internal combustion engine, a motor vehicle driven by an electric motor or a hybrid vehicle featuring an internal combustion engine and an electric motor. Being "embodied" is in particular intended specifically to mean being provided, configured, implemented, arranged and/or programmed.

A second aspect relates to a rotary pump, preferably one in which the rotational direction can be switched, featuring: a housing which comprises a pump space featuring an inlet into a low-pressure region of the pump space for a fluid or medium to be pumped and an outlet from a high-pressure region of the pump space for the fluid or medium to be pumped; at least one rotor which forms delivery cells in the pump space; at least one bearing for the at least one rotor and/or for a rotor shaft which is connected to the rotor; and a sealing stay which axially faces the rotor and separates the low-pressure region from the high-pressure region in the rotational direction of the rotor. In accordance with an aspect of the invention, the housing comprises an inner circumferential wall which radially delineates the pump space and, together with the at least one rotor, forms a radial sealing gap in order to seal off adjacent delivery cells, wherein the radial sealing gap varies in size in the rotational direction of the rotor. The inner circumferential wall comprises at least a first circumferential region between the low-pressure region and the high-pressure region and at least a second circumferential region between the low-pressure region and the high-pressure region, wherein the radial sealing gap in the first circumferential region is larger than the radial sealing gap in the second circumferential region. The rotary pump preferably lacks a lubricant feed as described with respect to the first aspect. An axial sealing gap between the sealing stay and the rotor is preferably constant or identical in the rotational direction. The bearing is preferably supplied with the delivered fluid via the axial sealing gap. The supply of the delivered fluid to the bearing is improved by the second circumferential region which exhibits the smaller radial sealing gap. The rotary pump of the second aspect can be embodied like the rotary pump of the first aspect, wherein the rotary pump of the second aspect lacks the lubricant feed.

BRIEF DESCRIPTION OF THE DRAWINGS

In the following, aspects of the invention are described in more detail on the basis of figures. The figures shoal example embodiments of a rotary pump, without thereby restricting aspects of the invention to the embodiments shown in the figures. Features essential to aspects of the invention which can only be gathered from the figures can advantageously develop the rotary pump of aspects of the invention, individually or in combination. The individual figures show.

DETAILED DESCRIPTION OF THE INVENTION

FIGS. 1A to 7 show a rotary pump 1 of a motor vehicle. The rotary pump 1 can be driven electrically. The rotary pump 1 is embodied as an externally toothed wheel pump. It is embodied as a gear pump. The rotary pump 1 is provided in order to lubricate and/or cool an axle gear system of the motor vehicle. Additionally or alternatively, the rotary pump 1 can be provided in order to suction a fluid from a fluid sump of the motor vehicle. The motor vehicle is embodied as a motor vehicle which is driven by an electric motor. It is embodied as an electric vehicle. The fluid delivered by the rotary pump 1 is embodied as an oil.

Figure 1B:
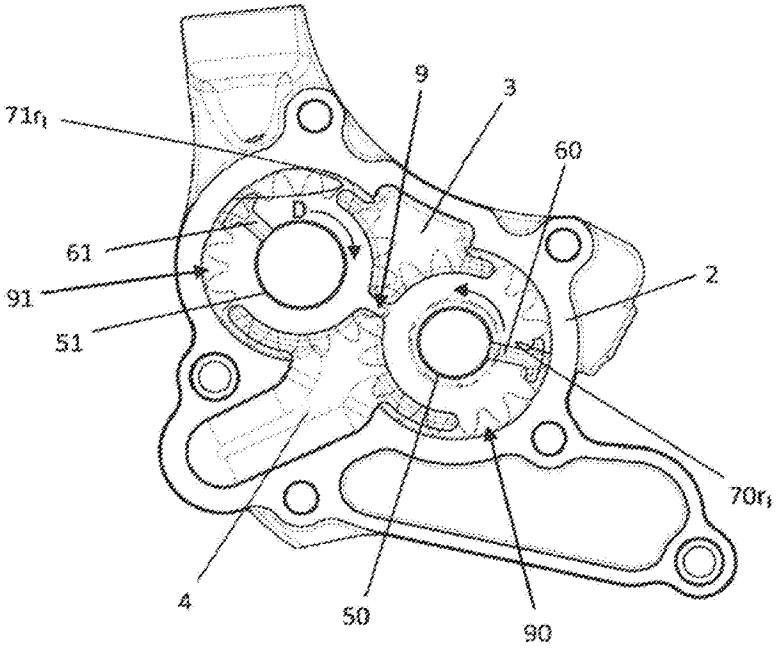
FIGS. 1A and 1B an open pump housing, with and without toothed wheels, featuring a T-shaped lubricant feed.
Figure 1A:
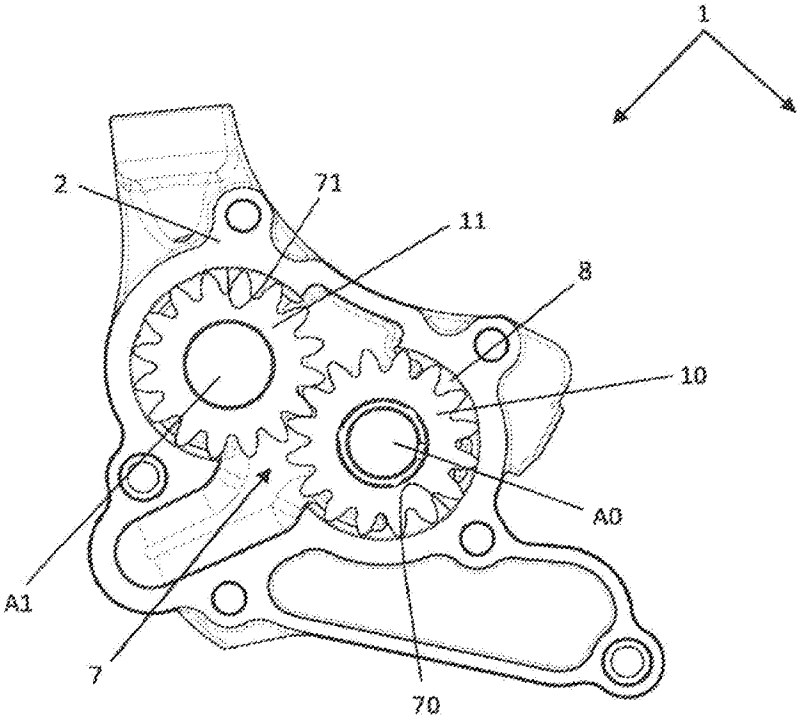

FIGS. 1A and 1B show a view into the open rotary pump 1, in two depictions. The rotary pump 1 comprises two rotors 10, 11, which mesh with each other, and a housing 2. The left-hand depiction in FIG. 1A shows the open rotary pump 1 together with the rotors 10, 11 arranged in it. The right-hand depiction in FIG. 1B shows the open rotary pump 1 without the rotors 10, 11, wherein the rotors 10, 11 are indicated. An inner surface of an axial side wall of the rotary pump 1, for example a base or a cover, can be seen.

Figure 2:
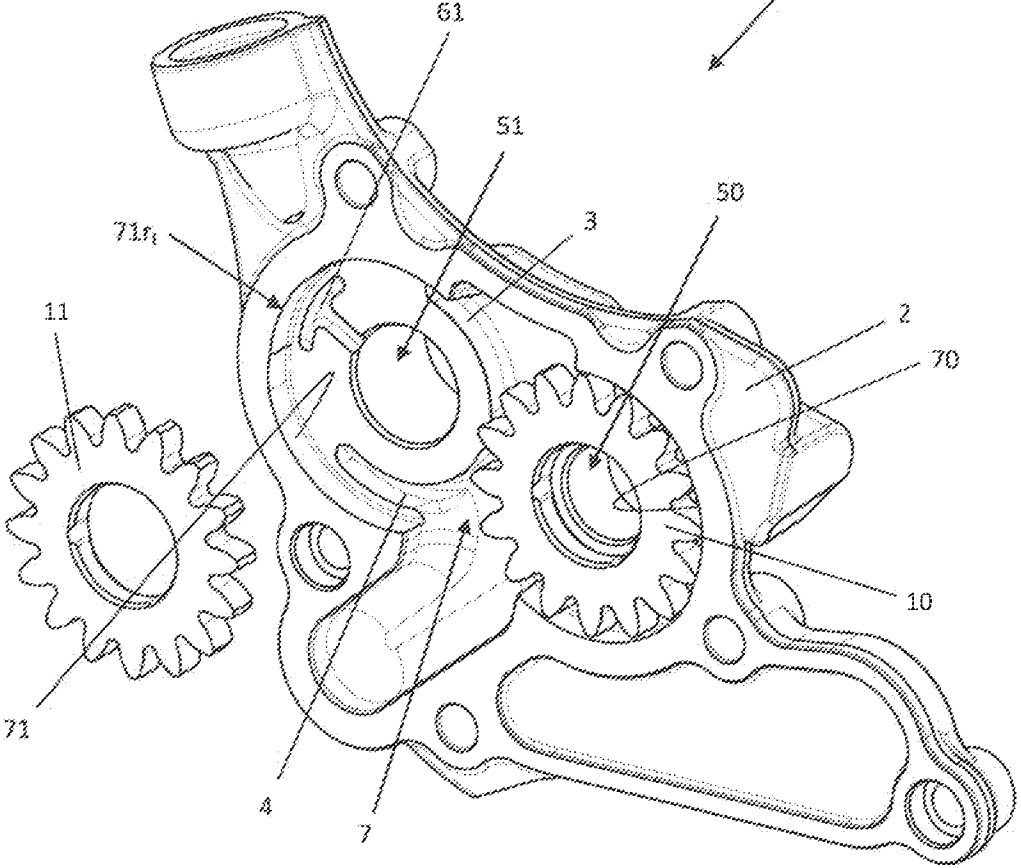
FIG. 2 a partial exploded drawing of the pump in accordance with FIG. 1.
Figure 3:
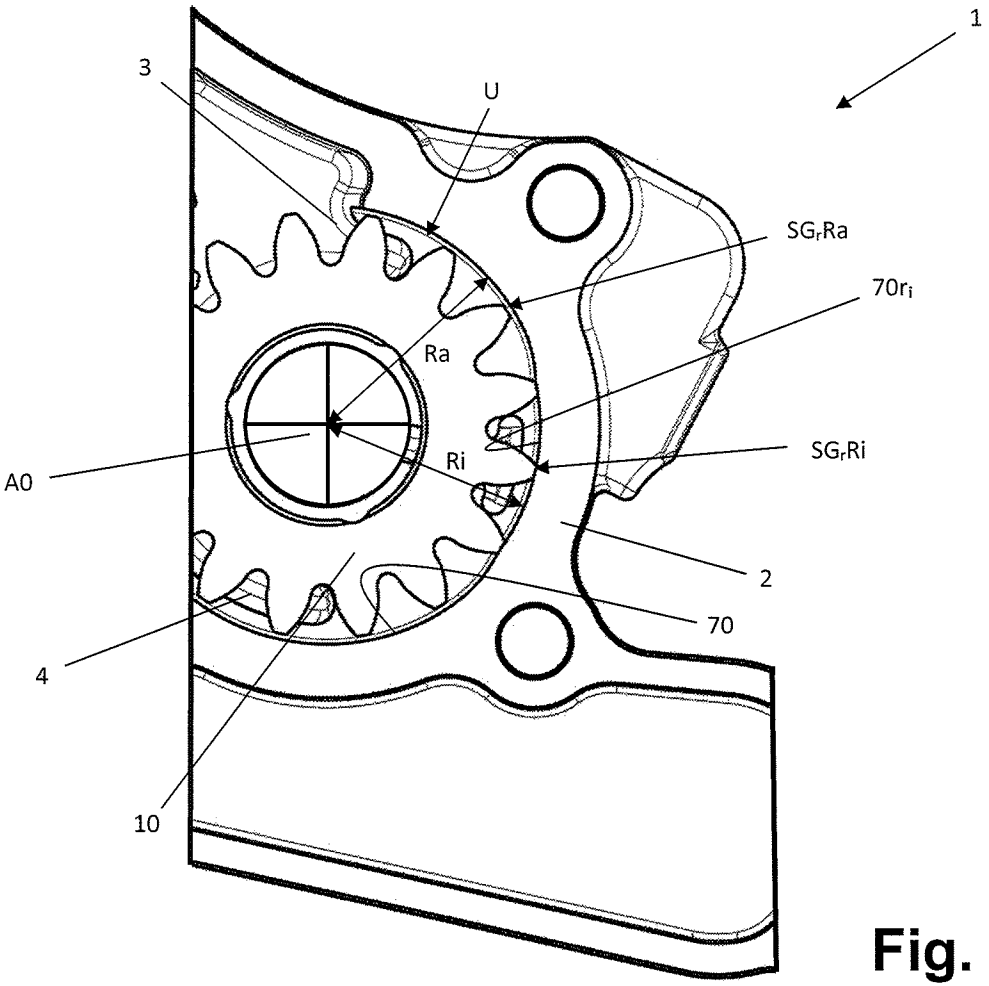
FIG. 3 an enlarged detail of the pump in accordance with FIG. 1.

FIG. 2 shows the open rotary pump 1 in a perspective partial exploded representation. FIG. 3 shows an enlarged portion of the open rotary pump 1. The rotors 10, 11 are embodied as externally toothed wheels.

The rotors 10, 11 are each arranged on a rotor shaft or axle A0, A1. The rotors 10, 11 are each arranged, secured against rotating and shifting, on the rotor shaft or axle A0, A1. They are each pressed onto the rotor shaft or axle A0, A1. The rotor shafts or axles A0, A1 are rotatably mounted in the housing 2 by bearings 50, 51. The bearings 50, 51 are embodied as shaft bearings. They are embodied as slide bearings. The rotor 11 is embodied as a driven rotor 11 which outputs onto the rotor 10.

The housing 2 forms a pump space 7 featuring an inner circumferential wall 70, 71. The housing 2 has an inlet 4 into the pump space 7 and an outlet 3 from the pump space 7. The inner circumferential wall 70, 71 and the rotors 10, 11 together form a radial sealing gap which can be referred to as a tip clearance. The radial sealing gap extends from the inlet 4 into the pump space 7 up to the outlet 3 from the pump space 7 in relation to each rotor 10, 11. The radial sealing gap can at least partially also overlap the inlet 4 and/or outlet 3. In the rotary pump 1 of the example embodiment, the radial sealing gap overlaps the inlet 4 and the outlet 3, as can in particular be seen in the right-hand depiction. The rotors 10, 11 form delivery cells 8 in the pump space 7. The delivery cells 8 are delineated by the base, the cover, the respective inner circumferential wall 70, 71 and the respective rotor 10, 11.

The inlet 4 and outlet 3 are defined according to the rotational direction D of the rotary pump 1 which is indicated in the right-hand depiction. The rotary pump 1 can be a reversible rotary pump 1, in which the rotational direction D can be changed, whereby the inlet 4 becomes the outlet from the pump space 7, and the outlet 3 becomes the inlet into the pump space 7. The inlet 4 and the outlet 3 are separated from each other in the rotational direction D by sealing stays 90, 91, such that the medium or fluid delivered by the rotary pump 1 cannot flow directly from the inlet 4 to the outlet 3. The fluid is transported from the inlet 4 to the outlet 3 in the delivery cells 8.

A driving stay 9 is formed in the region in which the two rotors 10, 11 mesh with each other, and in which the teeth of the two rotors 10, 11 are in maximum engagement with each other, and likewise fluidically separates the inlet 4 from the outlet 3 and prevents the inlet 4 and outlet 3 from being fluidically short-circuited.

In order to lubricate the bearings 50, 51, lubricant feeds 60, 61 are formed in the sealing stays 90, 91, wherein the lubricant feeds 60, 61 supply the bearings 50, 51 with the fluid from the pump space 7. The lubricant feeds 60, 61 are embodied in the shape of a T. The free end or root of the lubricant feed 60, 61 emerges into the respective bearing 50, 51, wherein the lubricant feed 60, 61 extends radially far enough away from the bearing 50, 51 that the delivery cells 8 pass over at least the tip of the lubricant feed 60, 61 when the rotor 10, 11 is rotating. The tip of the lubricant feed 60, 61 connects two directly adjacent delivery cells 8 to each other. It is in principle conceivable for the lubricant feed 60, 61, in particular the tip of the lubricant feed 60, 61, to connect at least two non-adjacent delivery cells 8 to each other.

The inner circumferential wall 70, 71 respectively comprises a circumferential region $\mathbf{70}_n$, $\mathbf{71}_n$ in which the radial sealing gap and/or tip clearance is smaller than in the rest of the circumferential region of the inner circumferential wall 70, 71. The circumferential regions $\mathbf{70}_n$, $\mathbf{71}_n$ are formed in the inner circumferential wall 70, 71 at the point at which an imaginary radial elongation of the lubricant feeds 60, 61 would meet the inner circumferential wall 70, 71. An extent of the circumferential regions $\mathbf{70}_n$, $\mathbf{71}_n$ in the rotational direction D of the rotary pump 1 is at least large enough that the circumferential region $\mathbf{70}_n$, $\mathbf{71}_n$ completely covers at least one delivery cell 8 at its furthest extent in the rotational direction D of the rotary pump 1. In the example embodiment, the circumferential regions $\mathbf{70}_n$, $\mathbf{71}_n$ extend over two adjacent delivery cells 8 when the rotor is correspondingly positioned, as can be seen in the right-hand depiction. These two delivery cells 8 are more effectively sealed off than the preceding and subsequent delivery cells 8 as viewed in the rotational direction D, due to the smaller radial sealing gap. A maximum extent of the circumferential regions $\mathbf{70}_n$, $\mathbf{71}_n$ is determined by the inlet 4 and outlet 3 or, respectively, by the profile of the inner circumferential wall 70, 71, under the premise that the lubricant feed 60, 61 is not to be directly connected to the inlet 4 and/or outlet 3.

As can best be seen in FIG. 3, the inner circumferential wall 70, 71 in the circumferential regions 70*n*, 71*n* is part of a circle around the axle A0, A1 having a radius Ri which is smaller than a radius Ra in the circumferential region of the inner circumferential wall 70, 71 outside the circumferential regions 70*n*, 71*n*, wherein the radius Ri substantially corresponds to the radius of a circular circumference U which contacts all the radially outer ends of the delivery elements (in the example embodiment shown, the teeth of the rotor 10, 11), i.e. the radial sealing gap $SG_r$Ri in the circumferential regions 70*n*, 71*n* is smaller than the rest of the sealing gap $SG_r$Ra between the rotor 10, 11 and the inner circumferential wall 70, 71, whereby the delivery cells 8 are more effectively sealed off in these circumferential regions 70*n*, 71*n*. The fluid in the more effectively sealed-off delivery cells 8 is thus at a higher pressure, which is advantageous for pressing the fluid into the bearing 50, 51. In the example embodiment, the transitions in the sealing gap are not stepped; instead, the inner circumferential wall 70, 71 transitions into the circumferential regions 70*n*, 71*n* in a curve.

FIG. 2 shows the left-hand depiction from FIG. 1 in a partial exploded representation. The two rotor shafts or axles A0, A1 are missing, and the rotor 11 has been removed from the pump space 7, while the rotor 10 lies in the pump space 7. The inlet 4, the outlet 3 and the lubricant feeds 60, 61 are incorporated in the axial inner side of the housing 2 which faces the rotors 10, 11. Radially opposite the lubricant feeds 60, 61, the inner circumferential wall 70, 71 comprises a circumferential region $\mathbf{70}_n$, $\mathbf{71}_n$ which protrudes radially inwards from the inner circumferential wall 70, 71. The inner circumferential wall 70, 71 and the circumferential regions $\mathbf{70}_n$, $\mathbf{71}_n$ extend over their entire axial length substantially perpendicular to the axial end-facing side of the housing 2.

Figure 4B:
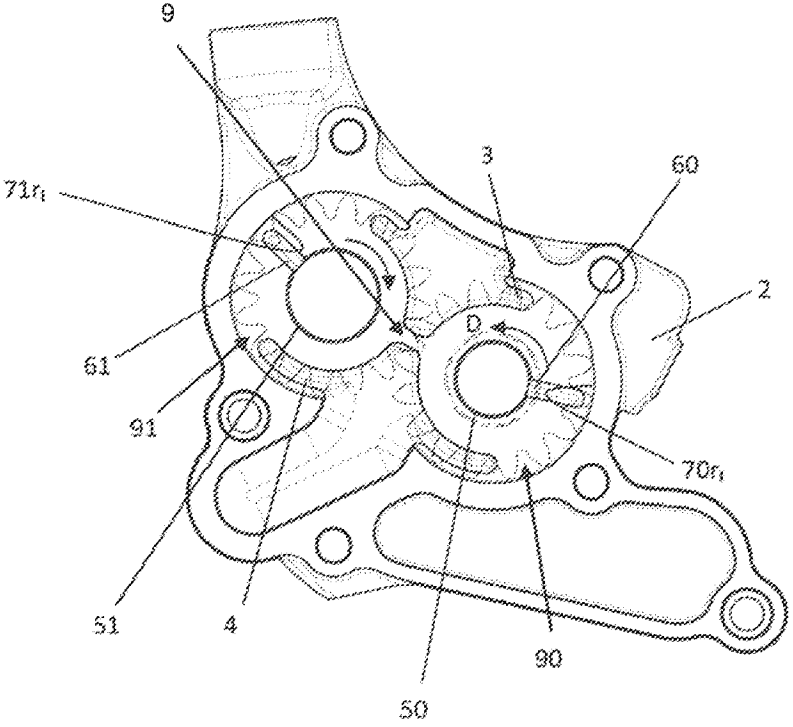
FIGS. 4A and 4B an open pump housing, with and without toothed wheels, featuring a straight lubricant feed.
Figure 4A:
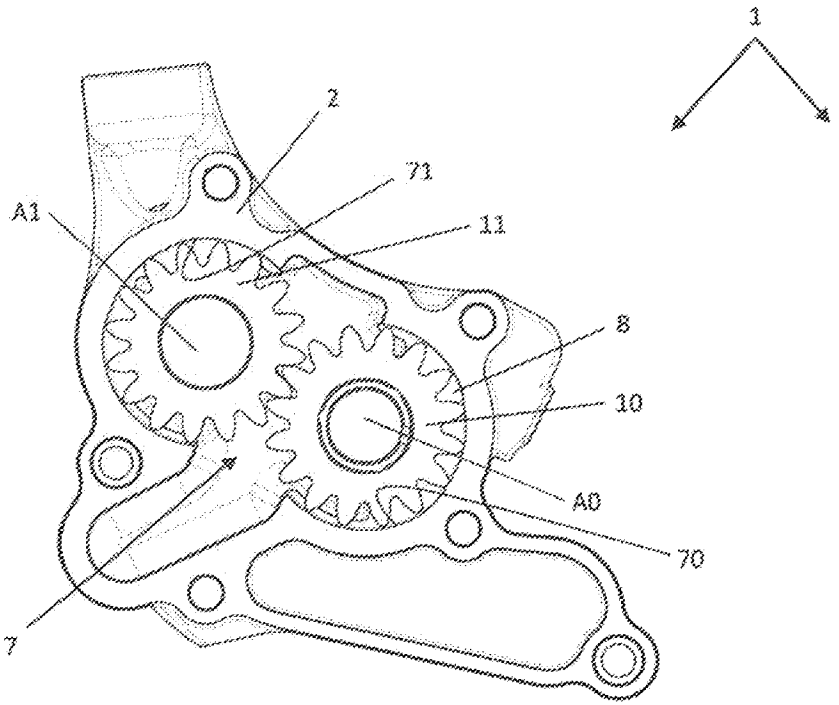

FIGS. 4A and 4B show a rotary pump 1 which is identical to the rotary pump 1 of FIGS. 1A and 1B except for the shape of the lubricant feed 60, 61 which in FIGS. 4A and 4B is formed as a straight line. The lubricant feed 60, 61 exhibits a width which substantially corresponds to a tooth width of a rotor 10, 11. The width of the lubricant feed 60, 61 can also be larger or smaller than the tooth width. If the width of the lubricant feed 60, 61 is larger than the tooth width, the lubricant feed 60, 61 connects two directly adjacent delivery cells 8 to each other.

Figure 5B:
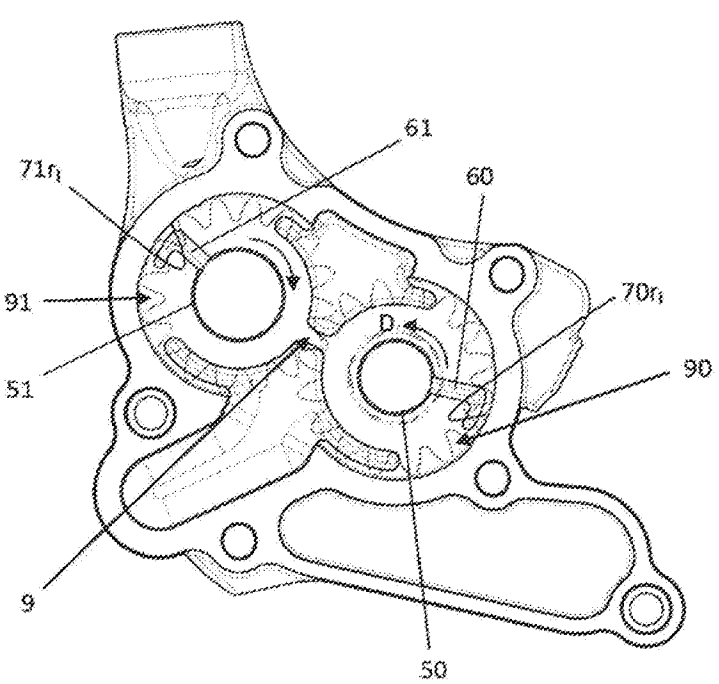
FIGS. 5A and 5B an open pump housing, with and without toothed wheels, featuring an L-shaped lubricant feed orientated counter to a rotational direction of the pump.
Figure 5A:
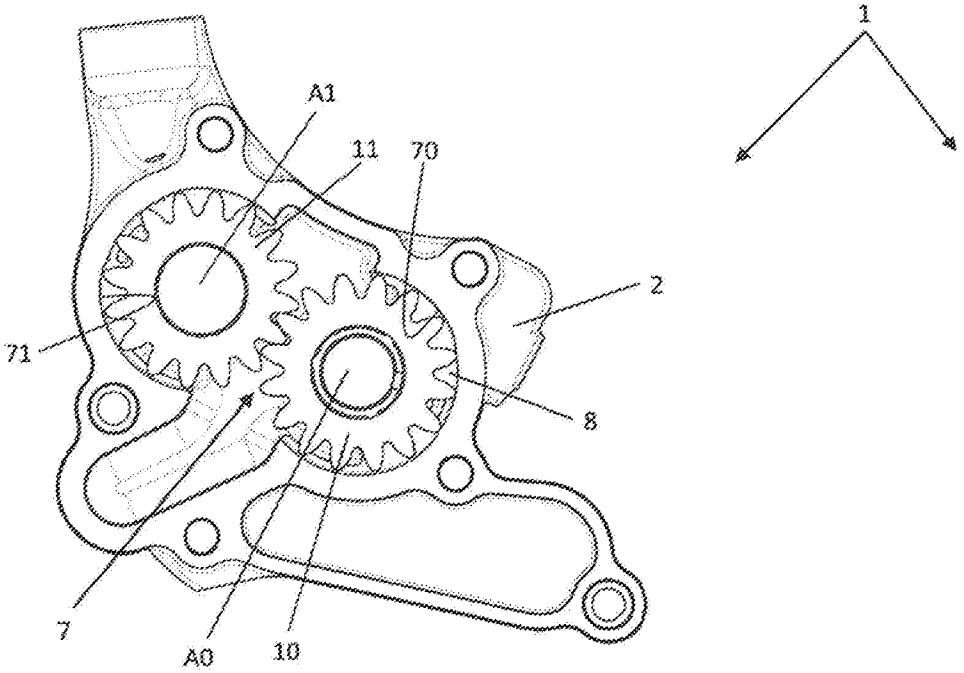
Figure 6B:
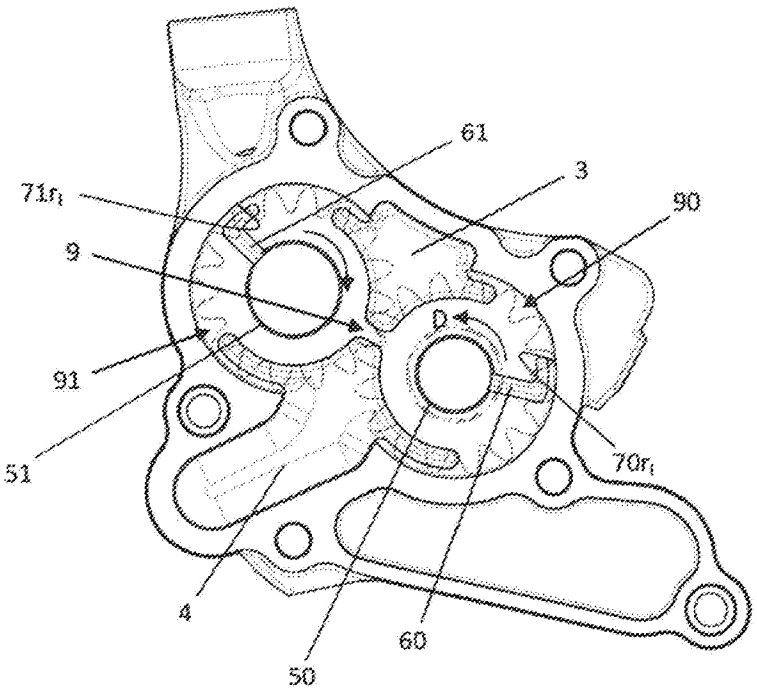
FIGS. 6A and 6B an open pump housing, with and without toothed wheels, featuring an L-shaped lubricant feed orientated in a rotational direction of the pump.
Figure 6A:
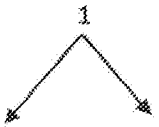
Figure 6A:
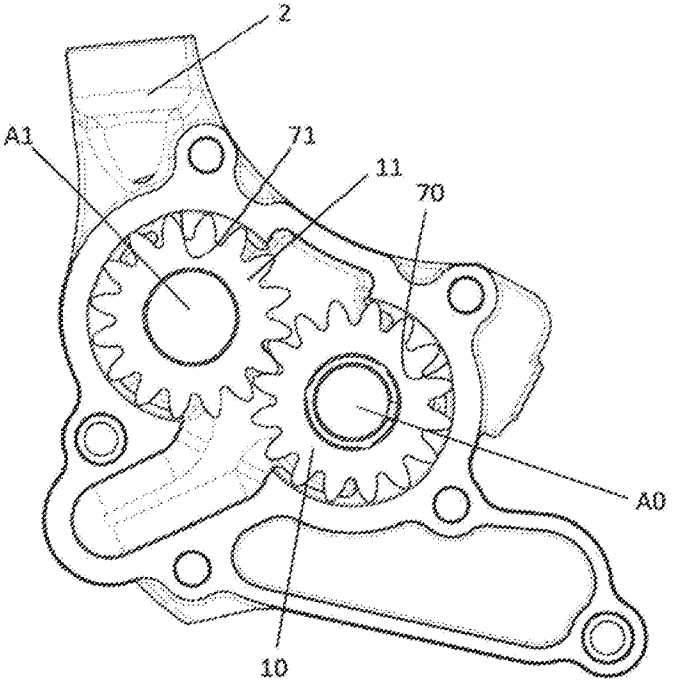

FIGS. 5A-6B likewise show the rotary pump 1 as in FIGS. 1A and 1B, only the lubricant feeds 60, 61 are L-shaped in these figures and extend counter to the indicated rotational direction D of the rotor 10, 11 in FIG. 5B and in the indicated rotational direction D in FIG. 6B.

Figure 7:
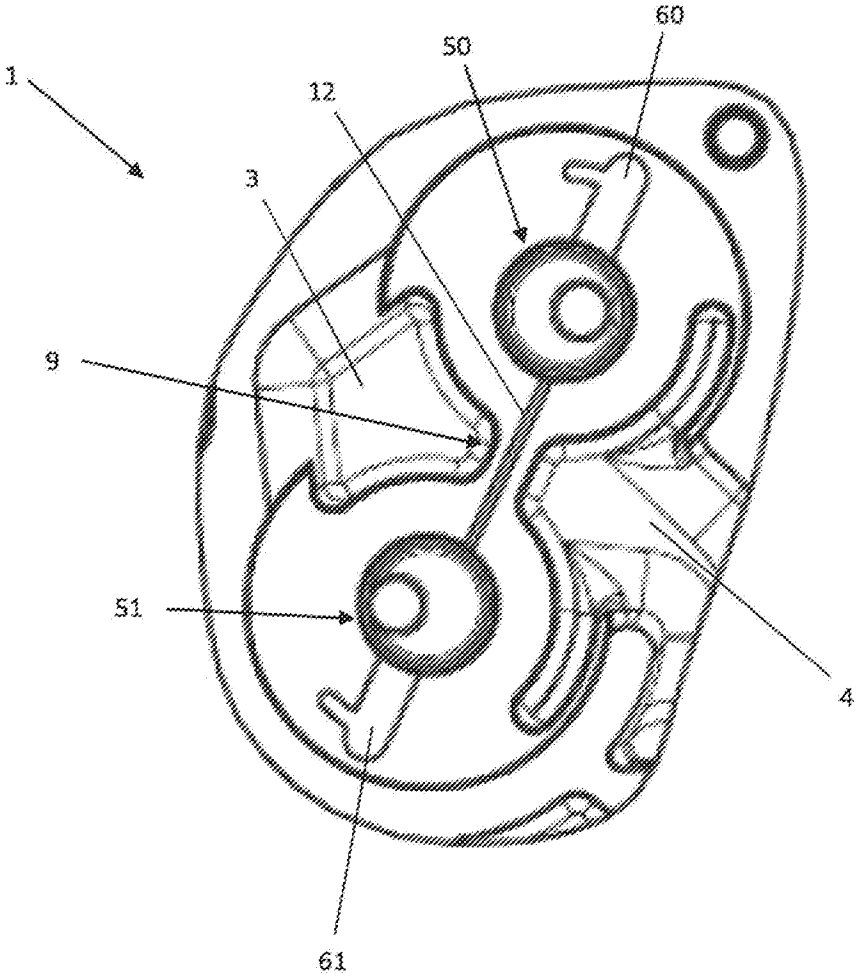
FIG. 7 an open pump housing, without toothed wheels, featuring an L-shaped lubricant feed and a connection which extends through the driving stay and fluidically connects bearings for the toothed wheel shafts to each other.

FIG. 7 shows a rotary pump 1 without the rotors 10, 11. Unlike the rotary pumps 1 in accordance with FIGS. 1A to 6B, the rotary pump 1 in accordance with FIG. 7 comprises a connection 12 which fluidically connects the bearings 50, 51 and the two lubricant feeds 60, 61 to each other via the driving stay 9.

Figure 8:
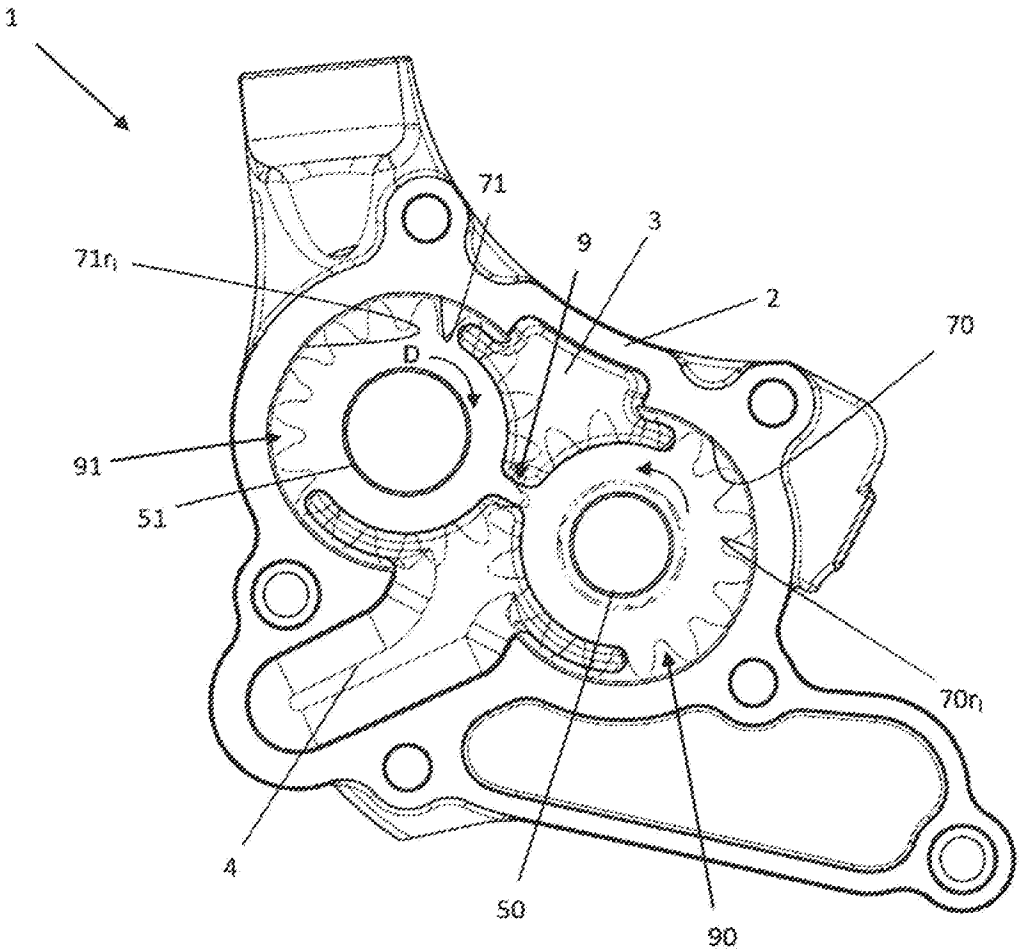
FIG. 8 an open pump housing of a rotary pump in which the lubricant feed has been omitted.

FIG. 8 shows a rotary pump 1 which does not comprise any lubricant feeds. Aside from the lubricant feeds, the rotary pump 1 in FIG. 8 is identical to the rotary pump 1 shown in FIGS. 1A to 3. Unlike the rotary pump 1 in accordance with FIGS. 1A to 3, the rotary pump 1 in accordance with FIG. 8 lacks the lubricant feeds.

Like the rotary pump 1 of FIGS. 1A to 3, the inner circumferential wall 70, 71 of the rotary pump 1 in accordance with FIG. 8 respectively comprises a circumferential region $\mathbf{70}_n$, $\mathbf{71}_n$ in which the radial sealing gap and/or tip clearance is smaller than in the rest of the circumferential region of the inner circumferential wall 70, 71. The circumferential regions $\mathbf{70}_n$, $\mathbf{71}_n$ are formed in the inner circumferential wall 70, 71 between the inlet 4 and the outlet 3, substantially centrically as viewed in the rotational direction D. An extent of the circumferential regions $\mathbf{70}_n$, $\mathbf{71}_n$ in the rotational direction D of the rotary pump 1 is at least large enough that the circumferential region $\mathbf{70}_n$, $\mathbf{71}_n$ completely covers at least one delivery cell 8 at its furthest extent in the rotational direction D of the rotary pump 1. The circumferential regions $\mathbf{70}_n$, $\mathbf{71}_n$ extend over two adjacent delivery cells 8 when the rotor is correspondingly positioned. These two delivery cells 8 are more effectively sealed off than the preceding and subsequent delivery cells 8 as viewed in the rotational direction D, due to the smaller radial sealing gap.

LIST OF REFERENCE SIGNS

1 rotary pump
2 housing
3 outlet
4 inlet
50 bearing
51 bearing
60 lubricant feed
61 lubricant feed
7 pump space
70 inner circumferential wall
71 inner circumferential wall
70$_n$ circumferential region
71$_n$ circumferential region
8 delivery cell
9 driving stay
90 sealing stay
91 sealing stay
10 rotor
11 rotor
12 connection
A0 axle
A1 axle
D rotational direction
Ra radius
Ri radius
U circular circumference

The invention claimed is:

1. A rotary pump, the rotational direction of which can be switched, comprising:

a) a housing comprising a pump space featuring an inlet into a low-pressure region of the pump space for a fluid to be pumped and an outlet from a high-pressure region of the pump space for the fluid to be pumped;

b) at least one rotor which forms delivery cells in the pump space;

c) at least one bearing;

d) at least one sealing stay which axially faces the at least one rotor and separates the low-pressure region from the high-pressure region in the rotational direction of the at least one rotor; and e) at least one lubricant feed, in the at least one sealing stay, which feeds a fluid, as a lubricant, from at least one of the delivery cells to the bearing, wherein the at least one lubricant feed connects at least two adjacent delivery cells to each other in at least one position of the at least one rotor.

2. The rotary pump according to claim 1, wherein the housing comprises an inner circumferential wall which radially delineates the pump space and, together with the at least one rotor, forms a radial sealing gap between the inner circumferential wall and a radial outer end of the at least one rotor, wherein the radial sealing gap varies in size in the rotational direction of the at least one rotor.

3. The rotary pump according to claim 2, wherein the radial sealing gap has a radial width which is smaller, in a circumferential region of the inner circumferential wall which lies opposite the at least one lubricant feed, than an average radial width of the radial sealing gap.

4. The rotary pump according to claim 2, wherein the radial sealing gap in a circumferential region between the low-pressure region and the at least one lubricant feed, and/or the radial sealing gap in a circumferential region between the high-pressure region and the at least one lubricant feed, has a radial width which is larger than a radial width of the radial sealing gap in the circumferential region opposite the at least one lubricant feed.

5. The rotary pump according to claim 1, wherein the at least one lubricant feed is a recess which extends in the radial direction from the at least one bearing up to and into the at least one of the delivery cells which passes over the recess.

6. The rotary pump according to claim 1, wherein the at least one lubricant feed comprises at least one elongation which extends substantially in and/or counter to the rotational direction of the rotary pump, at or near an end which faces away from the at least one bearing.

7. The rotary pump according to claim 1, wherein there is no position of the at least one rotor at which the at least one lubricant feed is short-circuited with the inlet into the pump space or the outlet from the pump space.

8. The rotary pump according to claim 1, wherein: the rotary pump comprises two rotors including the at least one rotor and a second rotor in the form of toothed wheels; the two toothed wheels mesh with each other in a driving stay; each of the two rotors is assigned a bearing, a sealing stay, and a lubricant feed; and the respective lubricant feeds of the two rotors are connected to each other via the driving stay.

9. The rotary pump according to claim 1, further comprising an electric motor which drives the at least one rotor.

10. The rotary pump according to claim 1, wherein the rotary pump is an external-axle pump.

11. The rotary pump according to claim 1, wherein the at least one lubricant feed is a groove which extends in the radial direction from the bearing up to and into at least one delivery cell which passes over the groove.

12. The rotary pump according to claim 1, wherein the rotary pump is an externally toothed wheel pump.

13. The rotary pump according to claim 1, wherein the at least one lubricant feed is embodied in the shape of a T.

14. A rotary pump, a rotational direction of which can be switched, comprising:

a) a housing comprising a pump space featuring an inlet into a low-pressure region of the pump space for a fluid to be pumped, an outlet from a high-pressure region of the pump space for the fluid to be pumped, and an inner circumferential wall which radially delineates the pump space;

b) at least one rotor which forms delivery cells in the pump space and, together with the inner circumferential wall, forms a radial sealing gap to seal off adjacent delivery cells; and c) at least one sealing stay which axially faces the at least one rotor and separates the low-pressure region from the high-pressure region in the rotational direction of the at least one rotor, wherein d) the radial sealing gap varies in size in the rotational direction of the rotor, wherein the inner circumferential wall comprises at least one circumferential region which radially extends into the pump space, wherein the inner circumferential wall comprises a first circumferential region between the low-pressure region and the high-pressure region, a second circumferential region between the low-pressure region and the high-pressure region, and a third circumferential region between the low-pressure region and the high-pressure region, wherein the radial sealing gap in the first and third circumferential region is larger than the sealing gap in the second circumferential region, wherein the second circumferential region protrudes radially inwards from the inner circumferential wall, and wherein the second circumferential region is positioned in the sealing stay centrally viewed in the rotational direction of the at least one rotor between the first and third circumferential region.

15. A rotary pump, the rotational direction of which can be switched, comprising:

a) a housing comprising a pump space featuring an inlet into a low-pressure region of the pump space for a fluid to be pumped and an outlet from a high-pressure region of the pump space for the fluid to be pumped;

b) at least one rotor which forms delivery cells in the pump space;

c) at least one bearing; and d) at least one sealing stay which axially faces the at least one rotor and separates the low-pressure region from the high-pressure region in the rotational direction of the at least one rotor; and e) at least one lubricant feed, in the at least one sealing stay, which feeds a fluid, as a lubricant, from at least one of the delivery cells to the at least one bearing, f) wherein the housing comprises an inner circumferential wall which radially delineates the pump space and, together with the at least one rotor, forms a radial sealing gap between the inner circumferential wall and a radial outer end of the at least one rotor, wherein a width of the radial sealing gap varies in size along the inner circumferential wall in the rotational direction of the at least one rotor, and g) wherein the width of the radial sealing gap in a circumferential region between the low-pressure region and the at least one lubricant feed and the width of the radial sealing gap in a circumferential region between the high-pressure region and the at least one lubricant feed are respectively larger than the width of the radial sealing gap in the circumferential region opposite the at least one lubricant feed, h) wherein the circumferential region opposite the at least one lubricant feed of the circumferential wall extends radially towards the at least one rotor to define the reduced width of the radial sealing gap positioned thereat.

* * * * *